US009169709B2

(12) United States Patent
Vincent et al.

(10) Patent No.: US 9,169,709 B2
(45) Date of Patent: Oct. 27, 2015

(54) SPOOL MODULE

(71) Applicant: Cameron International Corporation, Houston, TX (US)

(72) Inventors: Jack H. Vincent, Katy, TX (US); Brian Stiel, Houston, TX (US); John Bogard, Houston, TX (US)

(73) Assignee: OneSubsea IP UK Limited, London (GB)

( * ) Notice: Subject to any disclaimer, the term of this patent is extended or adjusted under 35 U.S.C. 154(b) by 138 days.

(21) Appl. No.: 13/666,813

(22) Filed: Nov. 1, 2012

(65) Prior Publication Data

US 2014/0116716 A1 May 1, 2014

(51) Int. Cl.
*E21B 33/035* (2006.01)
*E21B 43/01* (2006.01)

(52) U.S. Cl.
CPC ..... *E21B 33/0355* (2013.01); *E21B 43/01* (2013.01)

(58) Field of Classification Search
CPC ..... E21B 43/01; E21B 33/0355
USPC ..... 166/351, 344, 368, 264, 250.01; 702/12
See application file for complete search history.

(56) References Cited

U.S. PATENT DOCUMENTS

| | | | | |
|---|---|---|---|---|
| 5,971,077 | A * | 10/1999 | Lilley | 166/368 |
| 6,460,621 | B2 * | 10/2002 | Fenton et al. | 166/347 |
| 6,481,504 | B1 * | 11/2002 | Gatherar | 166/344 |
| 6,698,520 | B2 * | 3/2004 | Fenton et al. | 166/347 |
| 7,331,396 | B2 * | 2/2008 | Reimert et al. | 166/368 |
| 7,647,974 | B2 * | 1/2010 | Fenton | 166/368 |
| 7,967,066 | B2 * | 6/2011 | McStay et al. | 166/250.01 |
| 8,011,436 | B2 * | 9/2011 | Christie et al. | 166/359 |
| 8,302,684 | B2 * | 11/2012 | Eken | 166/250.01 |
| 2010/0101799 | A1 * | 4/2010 | Spencer et al. | 166/339 |
| 2010/0132800 | A1 * | 6/2010 | Jamaluddin et al. | 137/2 |
| 2011/0139460 | A1 * | 6/2011 | Selstad | 166/344 |
| 2012/0097383 | A1 | 4/2012 | Fenton | |
| 2012/0168171 | A1 | 7/2012 | Varpe | |
| 2013/0000918 | A1 * | 1/2013 | Voss | 166/344 |

FOREIGN PATENT DOCUMENTS

| | | | |
|---|---|---|---|
| WO | 00/47864 | A1 | 8/2000 |
| WO | 2012/051148 | A2 | 4/2012 |

OTHER PUBLICATIONS

Salies, Jaques, B. "RLWI: A Practical New Way to Bring Un-Productive Wells Back Into Production," Subsea Technology, FMC Technologies, (Aug. 2010), pp. 52-62.
FMC Technologies: Subsea Trees, brochure retrieved from www.fmctechnologies.com/subseatrees.com (2008), 4 pages.
FMC Technologies: Subsea Chokes and Flow Modules, brochure retrieved from www.fmctechnologies.com/subsea.com (2008), 8 pages.
International Search Report and Written Opinion dated Feb. 17, 2014 for PCT Application No. PCT/US2013/067263 filed on Oct. 29, 2013.

* cited by examiner

*Primary Examiner* — Matthew Buck
(74) *Attorney, Agent, or Firm* — Chamberlain Hrdlicka

(57) ABSTRACT

A spool module for a subsea well production tree and system is presented. The spool module is similar to traditional process modules, except that the spool module includes all its components and their conduits inside one body (or block). This module includes retrievable components used for production and annulus flow lines into one package. The spool module includes the production choke, annulus choke, and conduit bores integral in the block. The spool module includes all of these elements machined into one body having no additional conduits or piping outside of the body. The spool module may also be used in connection with a subsea tree during production of a well, or with several wells on a template or as part of a manifold.

22 Claims, 7 Drawing Sheets

SPOOL MODULE

BACKGROUND

Development and exploitation of undersea petroleum and natural gas deposits includes using offshore facilities to drill and produce oil and gas wells. The development of subsea oil and gas fields requires specialized equipment, including subsea production systems. The equipment must be reliable enough to safe guard the environment, and make the exploitation of the subsea hydrocarbons economically feasible.

A typical subsea system for drilling and producing offshore oil and gas can include the use of process modules that can be used to assist in production. Process modules can include individual components such as production chokes, annulus chokes, sensors, single phase or multi-phase flow meters, etc. A multi-phase flow meter is a device for measuring the velocity and phase composition (water, oil, gas) of fluid flow in a well, usually one completed for production or injection. A single-phase flow meter is a device for measuring the velocity of a single fluid in a well A choke is used to control fluid flow rate or downstream system pressure. The choke is available in several configurations for both fixed and adjustable modes of operation. Adjustable chokes enable the fluid flow and pressure parameters to be changed to suit process or production requirements. Fixed chokes do not provide this flexibility, although they are more resistant to erosion under prolonged operation or production of abrasive fluids. Additionally, the choke may be non-retrievable or retrievable separate from the process module.

Although these components are retrievable, most of these components can include extensive routed piping in between them. This packaging can create multiple connections that create potential leak paths and a large footprint, both of which can be undesirable. In addition, because all of these components are separately retrievable, they can be individually large.

BRIEF DESCRIPTION OF THE DRAWINGS

A better understanding of the various disclosed system and method embodiments can be obtained when the following detailed description is considered in conjunction with the drawings, in which.

DETAILED DESCRIPTION

Figure 1:
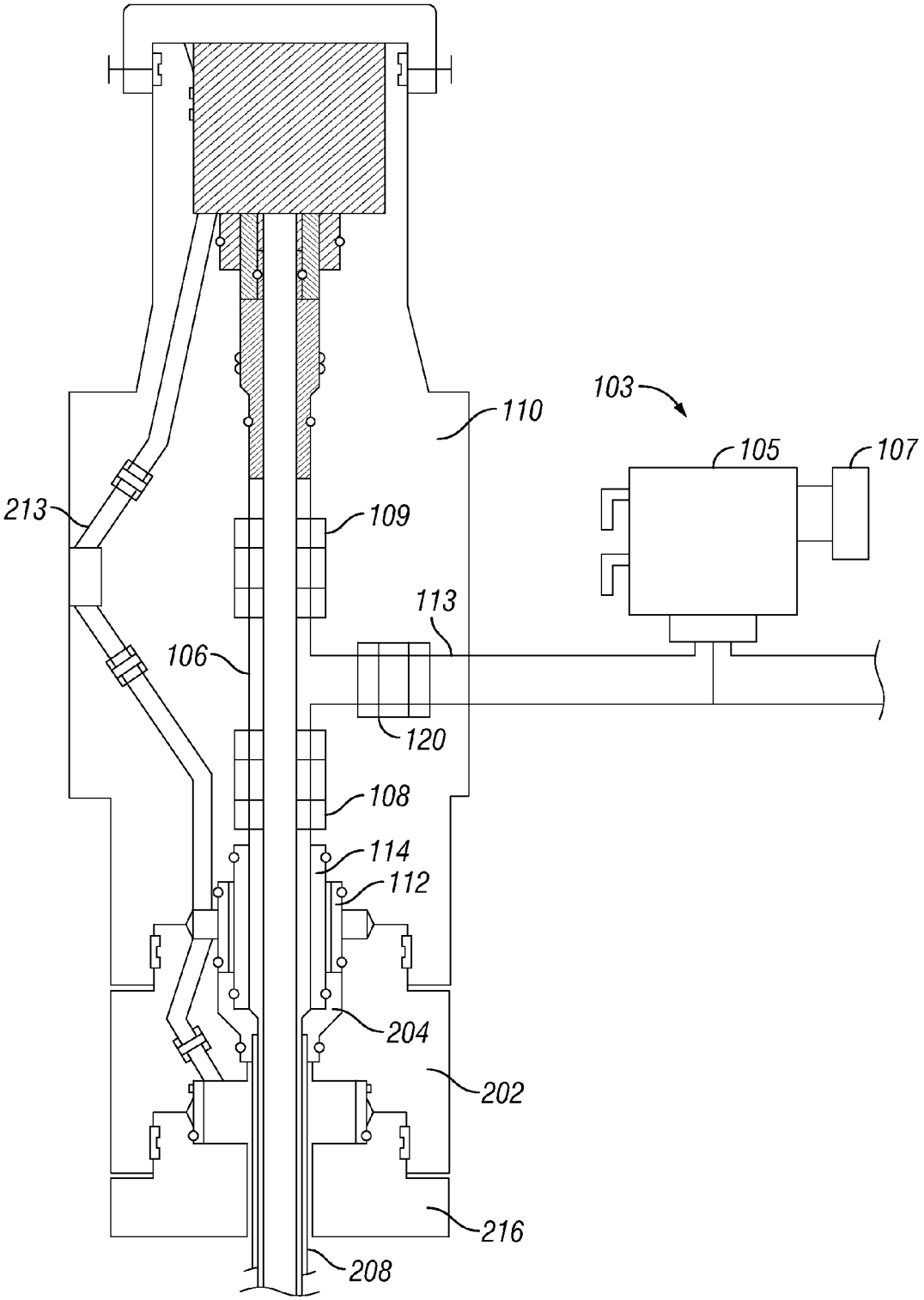
FIG. 1 is an illustrative view of a spool module connected to the production bore of a tree.

The following discussion is directed to various embodiments of the invention. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

FIG. 1 shows an embodiment of a subsea production system including a spool module 103 connected to a subsea flow control assembly, in this case a production tree 110 for the production of a subsea well. In this embodiment, the subsea production tree 110 is a subsea vertical production tree 110 attached above a tubing head spool 202, which is connected with a wellhead 216. A tubing hanger 204 with a vertical production bore is landed in the tubing head spool 202 below the tree 110 and supports a production tubing 208 extending into the well. The subsea tree 110 can be used to monitor and control the production of well fluids from a subsea well. Subsea trees can also manage fluids or gas injected into the well.

The production tree 110 also includes a vertical bore 106. Located along the vertical bore 106 is a production swab valve (PSV) 109 and a production master valve (PMV) 108. The tree 110 also includes a lateral production flow path 113 and an annulus flow path 213. Included along the lateral production flow path 113 is a production outlet valve (POV) 120 that operates as and in similar manner to the PSV 109 for controlling fluid flow through the lateral production bore.

As shown as an example in FIG. 1, the production tree 110 may be installed on a tubing head spool 202. A tree isolation sleeve 112 isolates the annulus flow path 213 from the production flow path 113 and allows for pressure testing of the tree connector gasket while isolating the tubing hanger from the test pressure. Alternatively, the production tree 110 may be installed directly to a wellhead assembly 216. The top of the tree isolation sleeve 112 seals against the production tree 110 and the bottom of the isolation sleeve 112 seals against the tubing head spool 202.

Primary and secondary sealing mechanisms, isolating the production flow path 113 from the annulus flow path 213 are provided by a production stab 114 constrained to the bottom of the tree body by the tree isolation sleeve 112. The top of the production stab 114 may seal against the tree body by means of, for example, a primary metal-to-metal seal and a secondary elastomeric seal. The bottom of the production stab 114 seals against the tubing hanger body by means of, for example, a primary metal-to-metal seal and secondary elastomeric seal.

The production bore communicates with the production tubing, and the annulus bore provides fluid communication with the annulus. Typical designs of trees have a side outlet (a production wing branch) to the production bore closed by a production wing valve for removal of production fluids from the production bore. The annulus bore also typically has an annulus wing branch with a respective annulus wing valve (not shown).

As shown in FIGS. 1-2, the spool module 103 includes a body 105. All of the elements of the spool module 103 (as will be described) are machined into one body 105 having no additional conduits or piping outside of the body 105 for those elements. The spool module 103 also includes a choke insert (or insert profile) 130 and a choke actuator 107. The choke insert with the choke actuator 107 would be installed on the spool module 103 to complete the assembly. The choke insert profile 130 houses the choke which limits the flow of fluid through a flow path internal to the body 105 and controls the fluid flow rate from the subsea well to a fluid production line (not shown) in fluid communication with flow path. The choke insert profile 130 is located inside the body 105 of the spool module 103.

The choke actuator 107 is connected with and used to actuate the choke. As an example, the actuator 107 can be a hydraulic stepping actuator of the type commonly used in choke actuation to convert the linear motion from hydraulic actuation into rotational motion to open or close the choke. Other types of chokes and choke actuators, such as linear actuating chokes, fast close/open modules, ROV override, etc. could be controlled similarly and can also be used.

The spool module 103 also includes one or more fluid sensors 125 that are pre-installed on the assembly using simple flange connections. The fluid sensors 125 are in fluid communication with the fluid in the entering flow path. The fluid sensors 125 typically measure at least one of the pressure and temperature of the incoming fluid. The fluid sensors 125 can also be of the type to measure composition, viscosity, density, etc. of the incoming fluid. The spool module 103 may also be used in other environments, such as on a horizontal tree, manifold, PLET (pipeline end termination), etc. The spool module can be beneficial when used in connection with a subsea tree during production of a well, or with several wells on a template or as part of a manifold. Manifolds are usually mounted on a template and often have a protective structure covering them that would be useful when combined with the structure of the spool module.

Figure 2B:
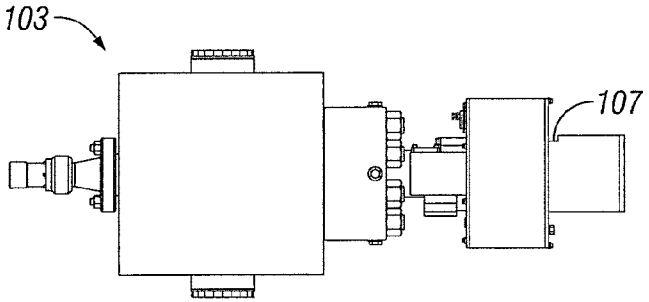
FIG. 2 shows multiple illustrative views (FIGS. 2A-2H) of a spool module.
Figure 2D:
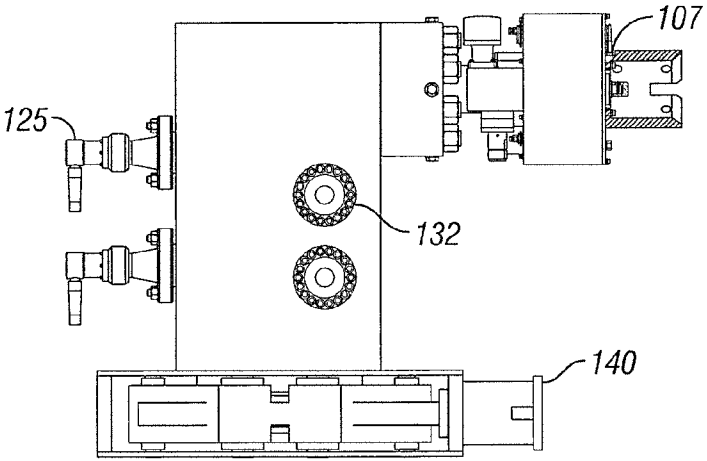
Figure 2A:
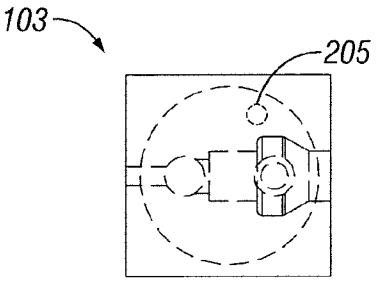
Figure 2C:
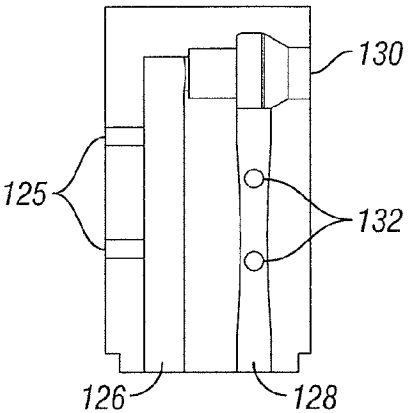
Figure 2F:
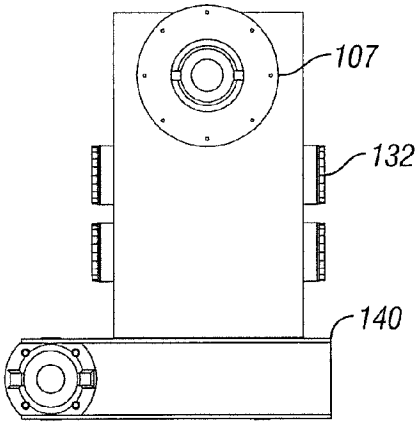
Figure 2H:
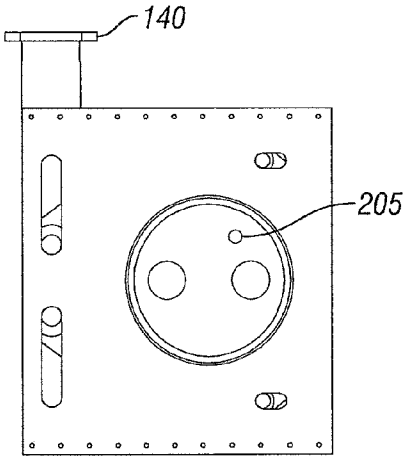
Figure 2E:
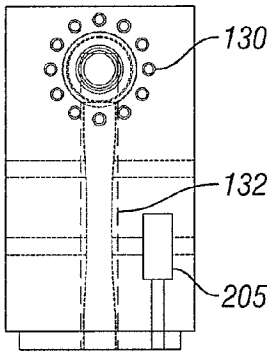
Figure 2G:
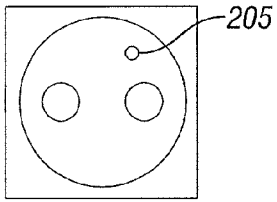

FIG. 2 shows multiple views of the spool module 103 including top views FIGS. 2A-2B, side views FIGS. 2C-2D, front views FIGS. 2E-2F, and bottom views FIGS. 2G-2H. The side views FIGS. 2C-2D show the most detail, and give a look inside the spool module 103. The fluid sensors 125 are shown to be in fluid communication with an entering flow path 126, taking measurements of the fluid in the entering flow path 126. After passing the fluid sensors 125, the fluid enters the choke 130 and then exits the spool module 103 via the exit flow path 128. While passing through the exit flow path 128, the flow rate of the fluid is measured by flow sensors 132. The flow sensors 132 can include a flow meter (or multiphase flow meter) to aid in measurement of the respective flow rates or flow volumes of gas and liquid, including gas and liquid mixtures. The multiphase flow meter is used to measure the individual phase flow rates of petroleum, water and gas mixtures produced during oil production processes. Additionally, the flow meter may also be able to detect any flow resistance change. The design of the process module 103 allows the flow paths, sensors, and choke to be included in the body 105 without the need for external connections and piping.

A clamp connector 140 is also illustrated in this embodiment. The clamp connector 140 is used to make a connection between two fluid carrying elements and may be any suitable type of clamp connector. Most of the fluid is carried under high pressure, and/or high temperature so preferably, the clamp connector 140 is suitable for use in environments with high pressure, both internal and external as a result of the deep water depth.

As an addition, an optional flow path access inlet 205 is shown in both the front view (FIG. 2E) and the bottom view (FIGS. 2G-2H) of FIG. 2. The flow path access inlet 205 is in fluid communication with the well and allows the introduction of fluids into the well. For example, the flow path access inlet 205 allows the injection of special chemical solutions into the well to improve oil recovery, remove formation damage, and the like. Formation damage can be caused by an alteration of characteristics of a producing formation from the exposure of drilling fluids. As an example, the water or solid particles in the drilling fluids, or both, tend to decrease the pore volume and effective permeability of the producible formation in the near-wellbore region. The flow path access inlet 205 can also be used to clean blocked perforations, reduce corrosion, upgrade crude oil, or address crude oil flow-assurance issues. The chemical injection can be administered continuously or in batches.

Figure 3:
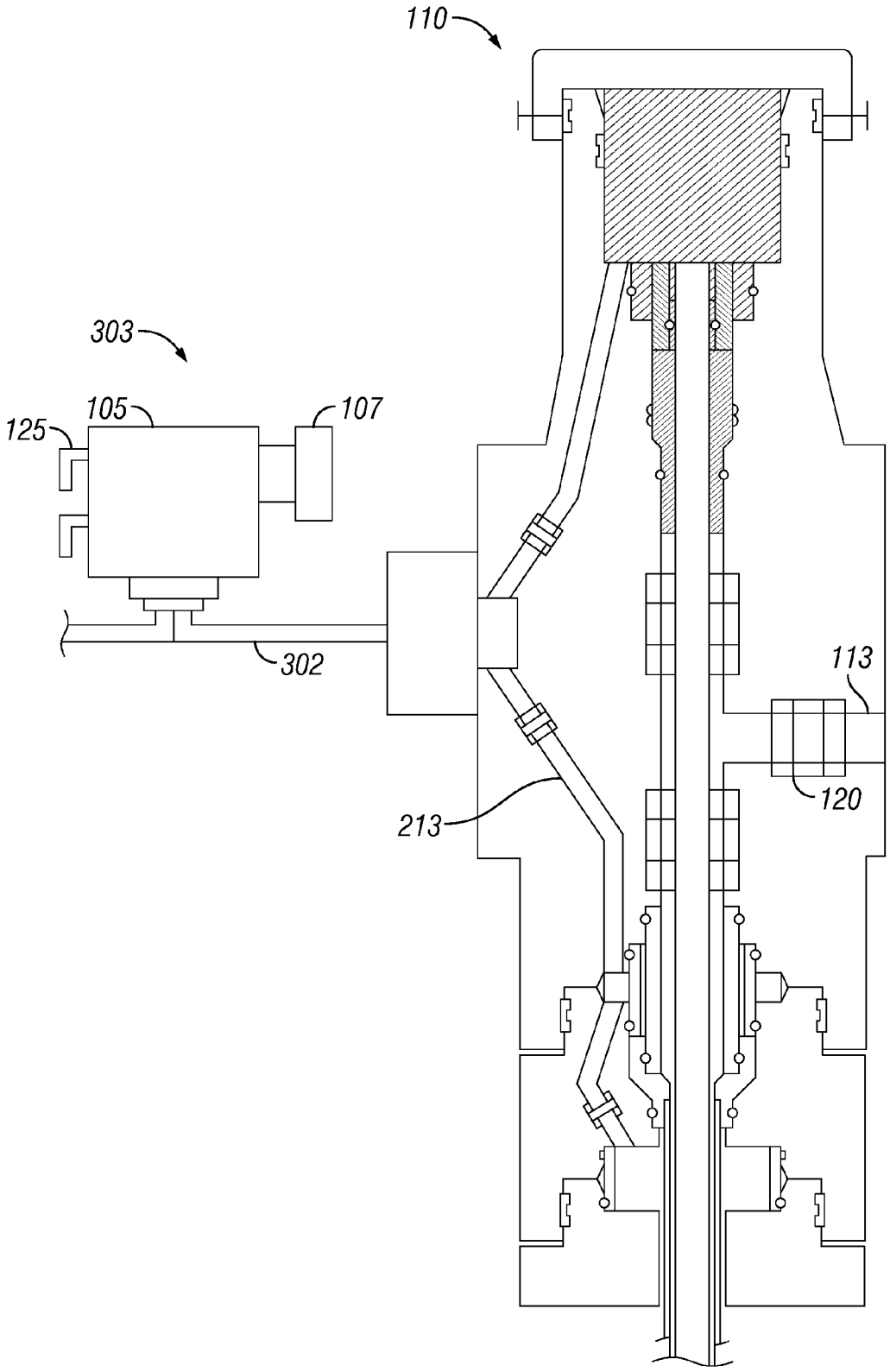
FIG. 3 is an illustrative view of a spool module connected to the annulus bore of a tree.

FIG. 3 shows another embodiment of the present invention. This embodiment illustrates a spool module 303 connected to the annulus flow path 213 of the subsea tree 110. The spool module 303 is similar to the spool module 103 shown in FIGS. 1 and 2 with the exception that it is connected for annulus fluid flow. As shown an inlet pipe 302 in fluid communication with the annulus flow path 213 connects to the spool module body 105. The spool module 303 also includes a body 105 and also includes a choke 130 (not shown) and a choke actuator 107. The choke 130 limits the flow of fluid through a flow path internal to the body 105 and controls the fluid flow rate from the subsea well to a fluid production line (not shown) in fluid communication with the annulus flow path in the spool body 105. The choke 130 may be located, for example, at least partially inside the body 105 of the spool module 103.

The fluid sensors 125 are in fluid communication with the annulus fluid coming from the inlet pipe 302. The fluid sensors 125 measure a characteristic of the incoming annulus fluid, such as pressure and temperature. The fluid sensors 125 of this embodiment can also be of the type to measure composition, viscosity, density, etc. of the fluid mixture. The choke actuator 107 is used to actuate the choke, and can be any type suitable for use with the annulus flow path 213. The design of the process module 303 allows the flow paths, sensors, and chokes to be included in the body 105 without the need for external connections and piping.

The spool module 303 operates in much the same manner as the spool module 103 shown in FIGS. 1-2 except that the fluid flowing through the spool module 303 is fluid from the annulus bore of the tree 110, which, for example, may be the fluid from the annulus between the production tubing 208 and the surrounding production casing.

Figure 4:
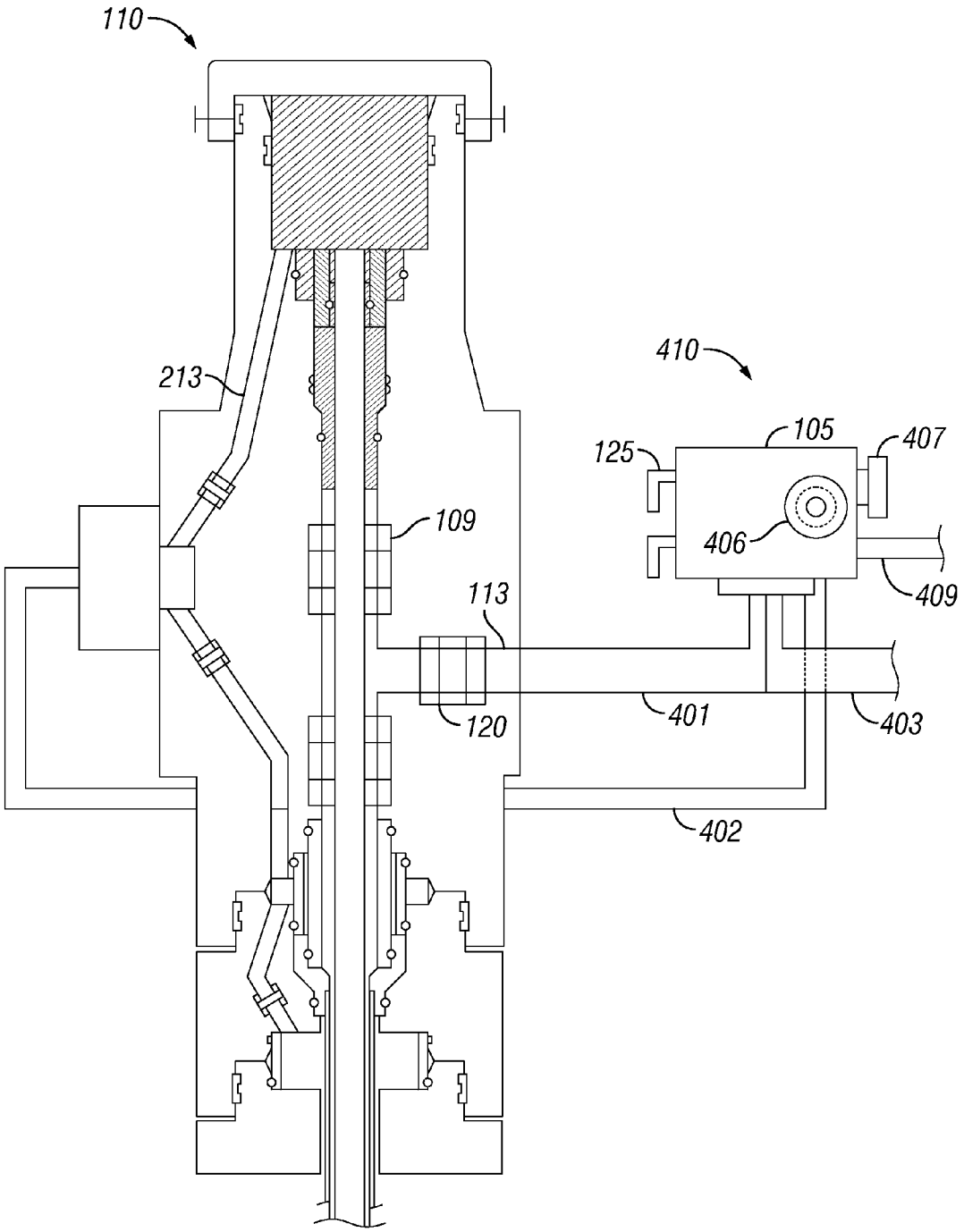
FIG. 4 is an illustrative view of a spool module connected to both the production flow path and annulus flow path of a tree.
Figure 5B:
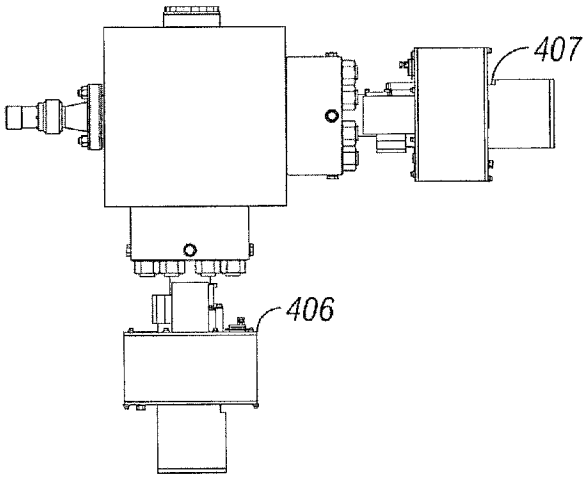
FIG. 5 shows multiple illustrative views (FIGS. 5A-5H) of a spool module that includes facility for the production and annulus flow paths as well as flow path access.
Figure 5D:
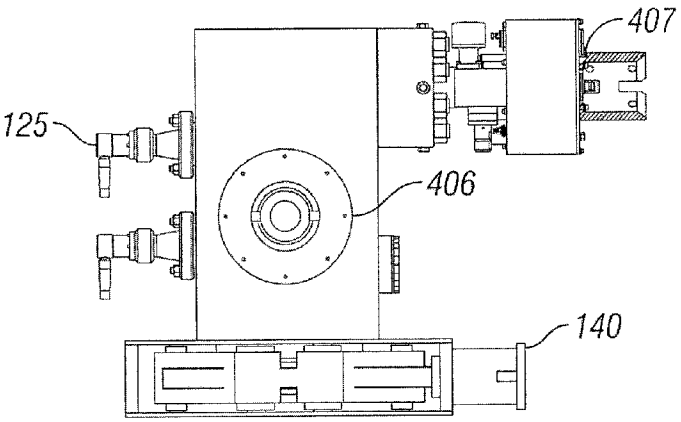
Figure 5A:
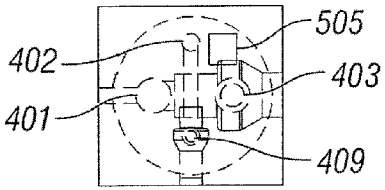
Figure 5C:
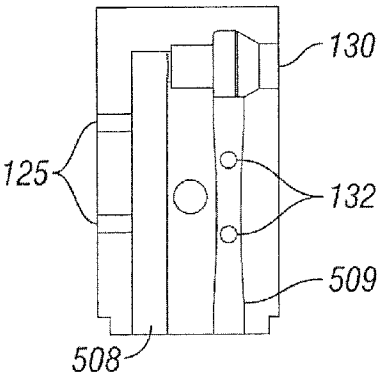
Figure 5F:
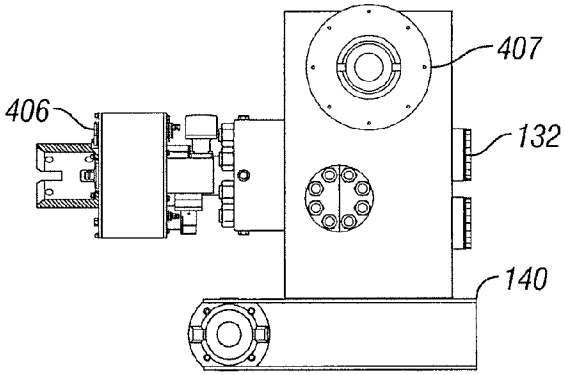
Figure 5H:
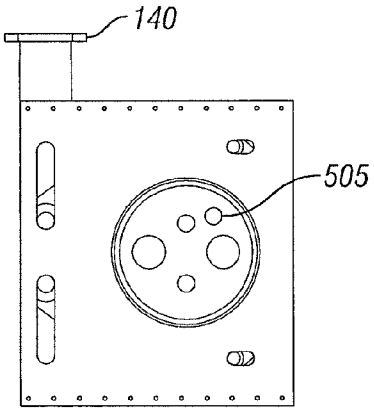
Figure 5E:
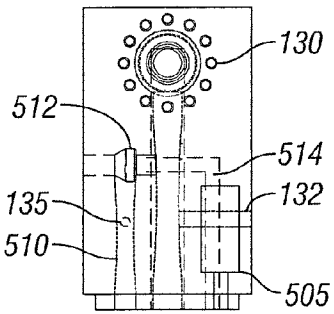
Figure 5G:
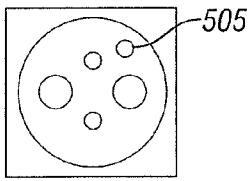

FIG. 4 shows an embodiment of the spool module 410 used for both the production flow path 113 and the annulus flow path 213 of the production assembly simultaneously. This system for producing fluid from a subsea well includes a production assembly (in this embodiment a subsea tree 110) including an annulus flow path 213 and a production flow path 113, and a spool module 410. The spool module 410 is similar to the spool modules 103, 303 described above and in addition to a first entering and exit flow path in fluid communication with the production flow path 113, the spool module 410 further includes a second entering flow path inside the spool module body in fluid communication with the annulus bore. This system also includes a second exit flow path inside the body and a second choke in fluid communication with and that can control flow between the second entering flow path and the second exit flow path.

As shown in FIGS. 4 and 5 (top views FIGS. 5A-5B, side views FIGS. 5C-5D, front views FIGS. 5E-5F, and bottom views FIGS. 5G-5H), the inlet pipe 401 of the production flow path 113 connects to the spool module body 105, and allows production fluid to flow into the spool module 410 into a production entering flow path 508. As the fluid flows in the production entering flow path, the fluid flows past fluid sensors 125, which are able to measure characteristics of the fluid, such as pressure, temperature, composition, viscosity, density, etc. The fluid then passes through the choke 130, and exits through a production exit flow path 509 and into the outlet pipe 403. The spool module 410 includes flow meter sensors 132 to measure flow characteristics of the production fluid in the production exit flow path 509. A production choke actuator 407 connects with the production choke 130 and is used to actuate the production choke 130.

The spool module 410 also includes annulus flow paths 510 and 514 in the body 105. As shown, an annulus inlet pipe 402 in fluid communication with the annulus flow path 213 connects to the spool module body 105 and allows annulus fluid to flow into the spool module 410 into the annulus entering flow path 510. As the fluid flows in the annulus entering flow path, the fluid flows past fluid sensors 135, which are able to measure characteristics of the fluid, such as pressure, temperature, composition, viscosity, density, etc. The fluid then passes through the annulus choke 512, and exits through an annulus exit flow path 514 and into the outlet pipe 409. The spool module 410 includes flow meter sensors 132 to measure flow characteristics of the annulus fluid in the annulus exit flow path 514. An annulus choke actuator 406 connects with the annulus choke 512 and is used to actuate the annulus choke 512, as shown from the top views in FIGS. 5A-5B. The embodiments shown in FIGS. 4 and 5 include the production flow path 113 in fluid communication with the production entering flow path 508 and the annulus flow path 213 in fluid communication with the annulus entering flow path 510. However, it should be appreciated that the entering flow paths may be placed in communication with either the production flow path 113 or the annulus flow path 213 and the labeling of the flow paths as production or annulus or as entering or exiting is for explanation purposes only. The design of the process module 410 allows the flow paths, sensors, and chokes to be included in the body 105 without the need for external connections and piping.

As an addition, an optional flow path access inlet 505 in the body 105 is shown in both the front view (FIG. 5E) and the bottom view (FIGS. 5G-5H) of FIG. 5. The flow path access inlet 505 is in fluid communication with the well and allows the introduction of fluids into the well. For example, the flow path access inlet 505 allows the injection of special chemical solutions into the well to improve oil recovery, remove formation damage, and the like. The flow path access inlet 505 can also be used to clean blocked perforations, reduce corrosion, upgrade crude oil, or address crude oil flow-assurance issues. The chemical injection can be administered continuously or in batches.

Other embodiments of the present invention can include alternative variations. These and other variations and modifications will become apparent to those skilled in the art once the above disclosure is fully appreciated. It is intended that the following claims be interpreted to embrace all such variations and modifications.

What is claimed is:

1. A process module for well fluid from a production assembly connected to a well comprising:

a single-piece body;

a choke attached to the single-piece body;

an entering flow path for the well fluid inside the single-piece body;

an exit flow path inside the single-piece body;

a flow meter attached to the single-piece body and in fluid communication with the exit flow path downstream of the choke; and wherein the choke is in fluid communication with and configured to control flow between the entering flow path and the exit flow path.

2. The module of claim 1, further including a fluid sensor in fluid communication with the entering flow path.

3. The module of claim 2, wherein the fluid sensor measures a temperature or a pressure of fluid in the entering flow path.

4. The module of claim 1, further including a choke actuator connected with the choke for actuating the choke.

5. The module of claim 1, wherein the entering flow path is in fluid communication with a production flow path from the production assembly.

6. The module of claim 1, wherein the entering flow path is in fluid communication with an annulus flow path from the production assembly.

7. The module of claim 1, the single-piece body further including a chemical injection inlet in the single-piece body in fluid communication with the well to introduce chemical fluids into the well.

8. The module of claim 1, further including:

the entering flow path being in fluid communication with a production bore from the production assembly;

a second choke;

a second entering flow path inside the single-piece body in fluid communication with an annulus bore of the production assembly;

a second exit flow path inside the single-piece body; and wherein the second choke is in fluid communication with and can control flow between the second entering flow path and the second exit flow path.

9. The module of claim 8, the single-piece body further including a flow path access inlet in the single-piece body in fluid communication with the well to introduce chemical fluids into the well.

10. The module of claim 4, wherein the production assembly includes a production or injection tree.

11. The module of claim 4, wherein the production assembly includes a production or injection manifold.

12. A system for producing fluid from a subsea well including:

a subsea production assembly including an annulus flow path and a production flow path; and a flow control module that includes:

a single-piece body;

a choke attached to the single-piece body;

an entering flow path for the well fluid inside the single-piece body;

an exit flow path inside the single-piece body;

a flow meter attached to the single-piece body and in fluid communication with the exit flow path downstream of the choke; and wherein the choke is in fluid communication with and configured to control flow between the entering flow path and the exit flow path.

13. The system of claim 12, further including a fluid sensor in fluid communication with the entering flow path.

14. The system of claim 13, wherein the fluid sensor measures a temperature or a pressure of fluid in the entering flow path.

15. The system of claim 12, further including a choke actuator connected with the choke for actuating the choke.

16. The system of claim 12, wherein the entering flow path is in fluid communication with the production flow path from the production assembly.

17. The system of claim 12, wherein the entering flow path is in fluid communication with the annulus flow path from the production assembly.

18. The system of claim 12, the single-piece body further including a flow path access inlet in the single-piece body in fluid communication with the well to introduce chemical fluids into the well.

19. The system of claim 12, further including:

a second choke;

a second entering flow path inside the single-piece body in fluid communication with an annulus bore of the production assembly;

and a second exit flow path inside the single-piece body; and wherein the second choke is in fluid communication with and can control flow between the second entering flow path and the second exit flow path.

20. The system of claim 19, further including a flow path access inlet in the single-piece body in fluid communication with the subsea well to introduce chemical fluids into the subsea well.

21. The system of claim 12, wherein the production assembly includes a production tree.

22. The system of claim 12, wherein the production assembly includes a production manifold.

* * * * *